United States Patent [19]

Nerheim et al.

[11] Patent Number: 4,831,933

[45] Date of Patent: May 23, 1989

[54] INTEGRATED SILICON BRIDGE DETONATOR

[75] Inventors: Eldon Nerheim, Edina; Leonard D. Hones, Eden Prairie; Patricia A. Douma, Coon Rapids; Earl W. McDonald, Eden Prairie, all of Minn.

[73] Assignee: Honeywell Inc., Minneapolis, Minn.

[21] Appl. No.: 182,379

[22] Filed: Apr. 18, 1988

[51] Int. Cl.[4] ..... F42C 19/12

[52] U.S. Cl. ..... 102/202.5; 102/202.9

[58] Field of Search ..... 102/202.5, 202.7, 202.9, 102/202.14

[56] References Cited

U.S. PATENT DOCUMENTS

| | | | |
|---|---|---|---|
| 1,636,734 | 7/1927 | Callis et al. | 86/20 R |
| 3,366,055 | 1/1968 | Hollander, Jr. | 102/202.5 |
| 3,742,811 | 7/1973 | Kabik et al. | 86/20 R |
| 3,882,323 | 5/1975 | Smolker | 102/202.5 |
| 3,882,324 | 5/1975 | Smolker et al. | 102/202.5 |
| 4,042,356 | 8/1977 | Voreck, Jr. et al. | 102/202.5 |
| 4,103,619 | 8/1978 | Fletcher et al. | 102/202.5 |
| 4,383,470 | 5/1983 | Assmann | 86/20 R |
| 4,559,875 | 12/1985 | Marshall | 102/218 |
| 4,592,282 | 6/1986 | Niemi et al. | 86/20 C |
| 4,632,009 | 12/1986 | Dann | 86/31 |
| 4,688,465 | 8/1987 | Melhus et al. | 86/20.14 |
| 4,708,060 | 11/1987 | Bickes, Jr. et al. | 102/202.5 |
| 4,729,315 | 3/1988 | Proffit et al. | 102/202.5 |

FOREIGN PATENT DOCUMENTS

| | | | |
|---|---|---|---|
| 2123122 | 1/1984 | United Kingdom | 102/202.5 |

*Primary Examiner*—Charles T. Jordan

*Attorney, Agent, or Firm*—Orrin M. Haugen; Thomas J. Nikolai; Frederick W. Niebuhr

[57] ABSTRACT

An explosive detonator consisting of an integrated circuit chip having a silicon substrate on which is formed an amorphous or polysilicon bridge, the bridge extending between two metal wire-bonding pads also on the substrate. The integrated circuit chip is disposed in close proximity to a primary charge such that when the bridge is energized by an electric current, it heats to the point where the charge is ignited. By back-etching the silicon substrate under the bridge, parasitic heat conduction is avoided. Further, by bonding a pyrex tube to the chip with the tube's bore surrounding the bridge, it is possible to pack the bore with an explosive train in fabricating the detonator assembly.

11 Claims, 1 Drawing Sheet

INTEGRATED SILICON BRIDGE DETONATOR

BACKGROUND OF THE INVENTION

I. Field of the Invention:

This invention relates generally to explosive detonator apparatus which may form part of a munitions fuze, and more particularly to a detonator device which is constructed using technology similar to that used in fabricating integrated circuit devices.

II. Discussion of the Prior Art:

In designing fuzes for munitions, it is imperative that the detonator function in a reliable and predictable manner. Moreover, given the hostile environment in which most munitions exist, the detonator must be able to withstand high G-forces without damage and without unwanted initiation.

Detonators are known in the art which utilize a so-called "bridgewire". The bridgewire is typically an electrical filament which, when made to carry an electric current, becomes heated to the point where an explosive packed around it can be ignited. A problem has existed with such detonators in that they tend not to be uniform in terms of their ignition properties. In particular, it is found that the bridgewires tend to be non-uniform in terms of their thermal properties, thus necessitating careful testing and monitoring of the detonator device during its various stages of manufacture. The Kabik et al U.S. Pat. No. 3,742,811 considers this problem in great detail and provides an electrical test instrument for continuously monitoring the variation in bridgewire thermal conductance so that loading pressure of the explosive material can be adjusted.

SUMMARY OF THE INVENTION

The present invention obviates the problems associated with such prior art bridgewires. In accordance with the present invention, the electroexplosive bridgewire is fabricated utilizing integrated circuit technology whereby consistently uniform detonating devices can be produced on a high-yield basis and at relatively low cost. Being a solid-state device, it can withstand high shock and vibration forces without damage. More particularly, the detonator may comprise an integrated circuit chip having a silicon substrate on which is formed, by known processes, a nitride layer and deposited or otherwise formed on the nitride layer is a strip of amorphous silicon or polysilicon. The strip includes metal wire-bonding pads on opposed ends thereof whereby electrical energy may be applied to the bridge. In use, a primary explosive, such as lead styphnate, is placed in intimate contact with the polysilicon bridge. When energy in the range from 500 to 100,000 ergs are applied to the bridge, its temperature is raised to the point where the lead styphnate pellet ignites.

In accordance with a primary feature of the invention, to concentrate the heat at the site of the bridge, the silicon substrate may be back-etched beneath the bridge, thus substantially eliminating the conduction of heat away from the bridge through silicon material and lowering the energy requirements for detonation of the charge.

A still further feature of the invention involved bonding a short length of glass tubing on end to the nitride layer with the bore of the tube surrounding the polysilicon bridge element. The glass tube may then be packed with explosive constituents, such as a first layer of lead styphnate, in close, intimate contact with the polysilicon bridge and a layer of lead azide packed on top of the lead styphnate. This integrated circuit device may then be placed in a detonator housing with its electrical leads extending through that housing. The detonator housing, in turn, may then be packed with further explosives, e.g., HMX. When electrical energy is applied to the terminals of the detonator, the polysilicon bridge is rapidly heated to a temperature at which the lead styphnate ignites and the ignition of the lead styphnate, in turn, ignites the lead azide and the HMX contained within the detonator.

OBJECTS

It is accordingly a principal object of the present invention to provide an improved detonator for an explosive device.

Another object of the invention is to provide a detonator device utilizing integrated circuit technology.

Yet another object of the invention is to provide an integrated circuit detonator including an amorphous silicon or a polysilicon bridge on a silicon substrate along with means for applying electrical energy to the bridge member for elevating its temperature to the ignition point of an explosive material placed in proximity with the bridge.

Still another object of the invention is to provide an integrated circuit detonator device having a bridge member formed on a silicon substrate with the silicon substrate being back-etched to eliminate unnecessary silicon material thus minimizing heat conduction away from the bridge.

A still further object of the invention is to provide an integrated circuit detonator device including a silicon substrate having a polysilicon bridge deposited thereon and a glass tube bonded to the substrate where the bore of the tube surrounds the bridge. The tube permits one or more layers of explosive material to be held therein.

The foregoing objects and advantages of the invention will become apparent to those skilled in the art from the following detailed description of a preferred embodiment, especially when considered in conjunction with the accompanying drawings in which like numerals in the several views refer to corresponding parts.

DESCRIPTION OF THE PREFERRED EMBODIMENT

Figure 1:
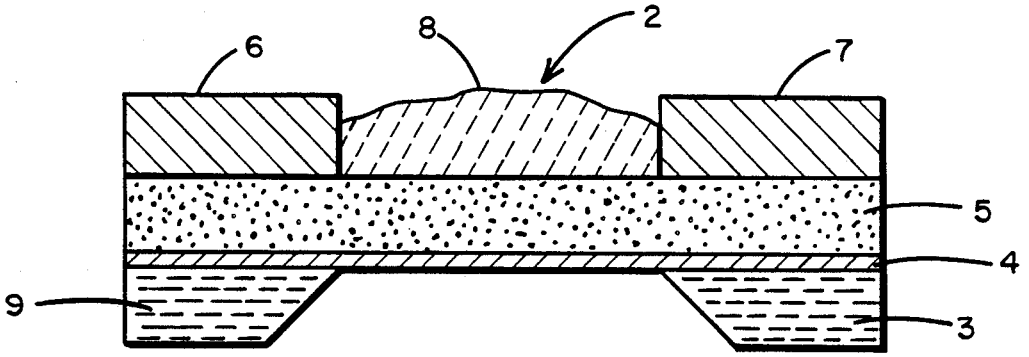
FIG. 1 is a cross-sectional view of the basic integrated circuit detonator of the present invention.

FIG. 1 is a cross-sectional view intended to show the constructional features of a first arrangement for an integrated circuit explosive detonation device. It is identified generally by numeral 2 and comprises an integrated circuit chip having a silicon substrate 3. The substrate 3 is processed in accordance with a known process, later described herein, to form a silicon nitride stop layer 4 on the upper major surface thereof. Following the formation of the silicon nitride layer 4, photolithography and chemical etching techniques are used to create a strip of amorphous silicon or polysilicon atop the nitride layer 4. The polysilicon strip or bridge is identified by numeral 5. Once the geometry of the polysilicon bridge 5 has been established, the device is metallized through a mask to form wire-bond pads 6 and 7 on opposed ends of the bridge 5.

The chip 2 in FIG. 1 may be placed in a lead frame in a manner described hereinbelow so that external electrical connections can be made to the wire-bond pads 6 and 7. By supplying electrical energy in the form of a current through the amorphous silicon or polysilicon bridge 5, it becomes heated because of the $I^2R$ loss. If a suitable explosive material, such as lead styphnate is placed in close contact relationship with the bridge 5 as indicated by numeral 8, the amount of heat generated in the bridge 5 can reach the point where the explosive material 8 is detonated. An important feature of the integrated circuit detonator of FIG. 1 resides in the manner in which the substrate 3 is back-etched as at 9 to create a frustoconical void beneath the bridge 5. This reduces the thermal mass to which the bridge 5 is exposed and limits the heat loss, via conduction, which would otherwise occur through the silicon substrate 3. Thus, the heat energy developed by the current flowing through the bridge 5 tends to be concentrated on the explosive charge 8.

As an alternative, it is possible to relocate the explosive charge 8 by positioning same within the back-etched void 9 in that it forms a pocket or recess for containing that charge.

Figure 2:
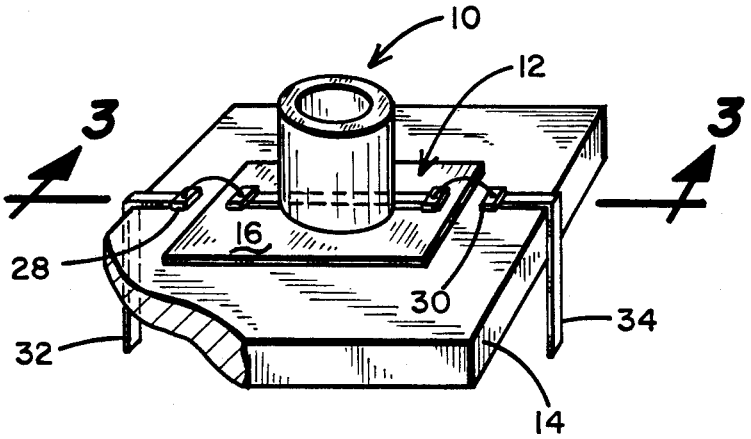
FIG. 2 is a perspective view of an integrated silicon detonator in accordance with an alternative embodiment of the present invention.
Figure 3:
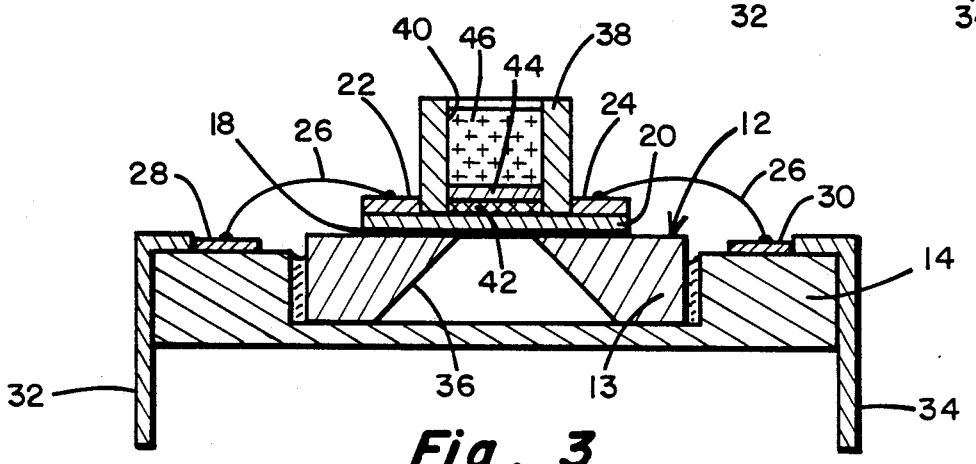
FIG. 3 is a cross-sectional view taken along the lines 3—3 in FIG. 2.

Referring to FIGS. 2 and 3, there is illustrated a portion of an overall detonator fabricated in accordance with another aspect of the present invention. It is identified generally by numeral 10 and it again comprises an integrated circuit chip 12 which here is shown surrounded by a lead frame 14 The chip 12 includes a silicon substrate 16 which has previously been sliced from a silicon wafer. The wafer has again been processed by first forming a silicon nitride layer 18 on an exposed major surface thereof. Following the formation of the nitride layer, a thin, elongated, narrow strip of amorphous silicon or polysilicon is deposited on the nitride layer 18, the silicon strip being identified by the numeral 20. The integrated circuit chip 12 further includes metal wire-bonding pads 22 and 24 formed on opposite end portions of the strip 20. Wire-bond conductors 26 are then ultrasonically or otherwise bonded to the pads 22 and 24 at one end and to terminal pads 28 and 30 formed on the lead frame 14. Terminal pins, as at 32 and 34, then extend from the lead frame whereby external connections can be made to the integrated circuit chip 12.

With particular reference to FIG. 3, it can again be observed that the silicon substrate 13 on which the nitride layer 18 is formed is back-etched to the plane of the nitride layer 18, thus leaving a generally conical void beneath a portion of the bridge 20. The back-etched aperture is identified by numeral 36 and tends to be conical in shape due to the undercutting occasioned by the acid-etching processes employed. The assembly of FIGS. 2 and 3 is further seen to include a short glass tube 38 which is bonded about one end to the exposed surface of the integrated circuit chip with its bore 40 oriented perpendicular to the plane of the substrate and generally centered about the silicon bridge 20. The tube 38 is arranged to be packed with one or more explosive materials and in the view of FIG. 3, three such layers are illustrated. The lowermost layer 42 abutting the surface of the bridge 20 may be a fairly sensitive explosive material, such as lead styphnate. Packed into the bore 40 of the tube 38 above the lead styphnate bead 42 is a further layer of explosive material, such as lead azide. It is identified in FIG. 3 by numeral 44. The remaining volume of the tube 38 may be next filled with more lead azide, but of a differing density. This layer is identified by numeral 46. While for purposes of explanation, certain explosive materials have been identified and recommended, those skilled in the art will recognize that other explosive materials can be used with the detonator assembly and, therefore, limitation to the particular compounds identified is not intended.

Figure 4:
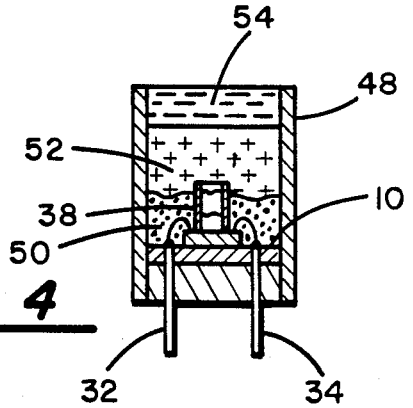
FIG. 4 shows the manner in which the integrated circuit device of FIG. 3 can be used as a component in a munitions detonator.

FIG. 4 shows the manner in which the integrated circuit device of FIGS. 1 and 2 may be embodied in a fuze for an explosive charge. Here, the device 10 is disposed within a hermetically sealed enclosure 48 with the leads 32 and 34 extending out from the enclosure 48 through appropriate hermetic seals (not shown). The device 10 may be held in place by a suitable inert backfilling material 50, such as exoxy. Located above the backfill material 50 is a lead azide explosive material 52 which preferably may have a density different from the lead azide material 44 contained within the bore of the tube 38. An additional explosive, such as HMX, may then be packed above the material 52 within the detonator housing 48. The HMX layer is identified by the numeral 54.

In use, the detonator of FIG. 4 would be used in combination with a main explosive charge to be detonated. When it is desired to set off the main charge, electrical energy in the form of a current is made to flow through the terminal pins 32 and 34 and thus will pass through the silicon bridge material 20. The bridge 20 being resistive in nature becomes rapidly heated to the point where the explosive material 42 (lead styphnate) ignites. This, in turn, sets off the other constituents of the explosive train, including the lead azide materials 44 and 46 contained within the bore 40 of the glass tube 38. The firing of this explosive material within the glass tube 38 serves to ignite the lead azide charge 52 and the HMX charge 54 contained within the detonator housing 48. The quantity of explosive contained within the detonator housing 48, when ignited, produces sufficient energy to rupture the housing and, in turn, set off the main charge.

Because of the manner in which the silicon substrate 13 is back-etched beneath the polysilicon bridge 20, practically all of the heat energy developed by the passage of the electrical current through the bridge is concentrated on the lead styphnate layer 42 and is not lost because of parasitic conduction through the substrate layer 13. The pyrex tube 38 not only serves to hold rather minute quantities of explosives, but serves to concentrate the energy released upon ignition of those explosives and to direct that energy into the larger charges 52 and 54 of the detonator.

The integrated silicon detonator embodiments of the present invention may be fabricated by starting in each case with a silicon substrate 13. They are readily available in wafer form from several manufacturers. Typically, such a substrate may be approximately 0.020 to 0.030 inch thick and may be 4 to 6 inches in diameter and capable of being later partitioned into a plurality of individual integrated circuit chips. The nitride layer may be formed on the major surface of the silicon substrate using low pressure chemical vapor deposition (LPCVD) processes with dichlorosilane and ammonia at an elevated temperature of between 700° C. to 800° C.

The silicon bridge may next be deposited, again using LPCVD processes. If the deposition temperatures are maintained above 580° C., a polycrystaline film (polysilicon) will result. If the deposition temperature is maintained below the 580° C. temperature, an amorphous silicon film will result.

The resistivity of the amorphous silicon or polysilicon layer can be controlled at this stage of the process by introducing dopant impurities into the silicon bridge material. In doing so, it is possible to maintain precise control over the current requirements necessary to initiate detonation.

To define the geometry of the bridge 5 or 20 at regularly spaced areas of the wafer substrate, a photosensitive material may be deposited on the surface of the amorphous silicon or polysilicon layer to allow definition of an image using a photolithography masking process. After the photosensitive material is optically exposed through the mask so as to define the desired shape, and following the development step, the mask image is effectively transferred to the substrate. The thustreated substrate is next subjected to selective wet chemistry. For example, a mixture of hydrofluoric acid and nitric acid can be used to rapidly etch silicon, but it will not etch the LPCVD nitride layer 18. The photoresist material shields the LPCVD silicon from the etchant, resulting in the photoresist image being etched into the LPCVD silicon.

Once the desired bridge geometry is established, the next step in the process is to strip away the photoresist, leaving the image of the photolithography mask etched into the polysilicon layer.

Now that the desired bridge shapes have been defined at multiple sites on the silicon wafer, copper, aluminum or other suitable metal may be deposited through a mask to form the bonding pad contacts 6-7 or 20-22. Following the metallization step, the wafer can be cut up into plural chips, each with the desired pattern thereon.

The back-etching of the substrate can readily be achieved, again through the use of selective wet chemistry. For example, a phosphoric acid can be used to rapidly etch the LPCVD nitride layer 20 and the silicon layer.

The glass tube 38 may be bonded to the nitride layer 20 in a thermoelectric glass bonding operation well known to persons skilled in the semiconductor arts.

This invention has been described herein in considerable detail in order to comply with the Patent Statutes and to provide those skilled in the art with the information needed to apply the novel principles and to construct and use such specialized components as are required. However, it is to be understood that the invention can be carried out by specifically different equipment and devices, and that various modifications, both as to equipment details and operating procedures, can he accomplished without departing from the scope of the invention itself.

What is claimed is:

1. A detonator comprising:

(a) a silicon chip having first and second major surfaces;

(b) a nitride layer formed on said first major surface;

(c) a strip of silicon disposed atop said nitride layer;

(d) first and second metal pads deposited on opposed end portions of said silicon strip;

(e) means for holding a primary explosive in intimate contact with said silicon strip; and (f) means for applying electrical energy to said silicon strip, via said first and second metal pads for generating sufficient heat to detonate said primary explosive.

2. The detonator as in claim 1 wherein said second major surface is back-etched toward said first major surface in the area juxtaposed with said silicon strip whereby the thermal mass of said area is decreased.

3. The detonator as in claim 1 wherein said strip of silicon is polysilicon.

4. The detonator as in claim 1 wherein said strip of silicon is amorphous silicon.

5. The detonator as in claim 3 or 4 wherein said strip of silicon is doped with impurities to provide a desired value of resistivity to said silicon strip.

6. The detonator as in claim 1 wherein said means for holding comprises a glass tube bonded to said nitride layer with the bore of said tube extending perpendicular to the plane of said first and second major surfaces and at least partially surrounding said silicon strip, said tube containing said primary explosive in said bore.

7. The detonator as in claim 6 wherein said primary explosive is an explosive train including a layer of lead styphnate adjacent a layer of lead azide and packed in said bore.

8. The detonator as in claim 1 wherein said means for applying electrical energy comprises a lead frame having at least two conductive leads extending therefrom; means for mounting said chip on said lead frame; and means for electrically connecting said conductive leads to said first and second metal pads.

9. A detonator for a main explosive charge comprising:

(a) an integrated circuit chip having a polysilicon bridge deposited on a silicon substrate, said bridge extending between first and second electrical contacts, said substrate being back-etched to remove the substrate material below said bridge;

(b) a tubular member bonded at one end to said substrate with the bore of said tube centered over at least a portion of said bridge; and (c) a primary explosive packed in the bore of said tube and abutting said bridge.

10. The detonator as in claim 9 wherein said tube is formed from pyrex glass.

11. The detonator as in claim 9 wherein said integrated circuit chip is mounted in a lead frame having terminal pins electrically joined to said electrical contacts.

* * * * *